United States Patent [19]

Connor et al.

[11] Patent Number: 4,693,109

[45] Date of Patent: Sep. 15, 1987

[54] SELF-ALIGNING TOOL ASSEMBLY FOR DIE SHAPING WORKPIECES

[75] Inventors: Mark J. Connor, Greenville, Del.; George H. Reinemuth, Glen Mills; Richard S. Cleveland, Swarthmore, both of Pa.

[73] Assignee: Wickes Manufacturing Company, Southfield, Mich.

[21] Appl. No.: 836,045

[22] Filed: Mar. 4, 1986

[51] Int. Cl.[4] ..... B21D 37/10; B21J 13/04

[52] U.S. Cl. ..... 72/456; 72/357; 72/359; 72/353; 72/361; 72/358; 72/344; 29/1.22

[58] Field of Search ..... 29/1.11, 1.1, 1.21, 29/1.22; 72/357, 354, 359, 402, 353, 361, 456, 358, 344

[56] References Cited

U.S. PATENT DOCUMENTS

| | | | |
|---|---|---|---|
| 146,092 | 12/1873 | Parmelee . | |
| 374,113 | 11/1887 | Cayley et al. . | |
| 430,541 | 6/1890 | Parmelee . | |
| 866,021 | 9/1907 | Hansen | 72/358 |
| 1,154,810 | 9/1915 | Ross . | |
| 2,261,304 | 11/1941 | Sparks | 29/1.21 |
| 2,411,379 | 11/1946 | Langhammer | 29/1.22 |
| 3,184,940 | 5/1965 | Sporck | 29/1.21 |
| 4,299,112 | 11/1981 | Kondo et al. | 72/358 |

*Primary Examiner*—Robert L. Spruill
*Assistant Examiner*—David B. Jones
*Attorney, Agent, or Firm*—Body, Vickers & Daniels

[57] ABSTRACT

A tool assembly for shaping workpieces, which comprises a reciprocable punch having a working end engageable with a die to shape a workpiece therebetween. The punch is mounted at its driven end on a reciprocable punch actuator and extends through a floating punch guide having an end adjacent the die which is axially and circumferentially engaged with a recess in the die to align the die and punch axes during the workpiece shaping operation. A workpiece feed tube opens laterally into the punch guide, and the punch guide is reciprocable in response to reciprocation of the punch to open and close the discharge end of the feed tube so as to assure singular feeding of workpieces to the die cavity.

33 Claims, 6 Drawing Figures

SELF-ALIGNING TOOL ASSEMBLY FOR DIE SHAPING WORKPIECES

BACKGROUND OF THE INVENTION

This invention relates to the art of die forming workpieces and, more particularly, to an improved tool assembly for maintaining alignment between a tool and die during the shaping of a workpiece therebetween.

The present invention finds particular utility in connection with the shaping of air gun pellets form a spherical lead workpiece and, accordingly, will be described in detail hereinafter in connection with such use. However, it will be appreciated that the invention can be used in connection with the production of other products and in connection with the die forming of products from workpieces other than lead.

It is of course well known that air gun pellets have an hourglass shape and are formed by inserting a lead workpiece of specific weight into the cavity of a split die and shaping the workpiece therein through the use of a punch. The punch is axially reciprocated relative to the die cavity and, following the forming operation, the split die opens, the punch is withdrawn and the pellet stripped therefrom. The dies are then closed, a new workpiece is introduced between the punch and die, and the forming procedure is repeated.

A number of problems are encountered in connection with high speed production of such pellets including, for example, excessive wear of relatively moving parts of the tool assembly. Such wear results from extrememly close tolerances between the relatively moving parts and the difficulty in maintaining alignment between relative displaceable parts which move into and out of engagement with one another, such as the working end of the punch and die cavity in which the workpiece is shaped. Such alignment problems impose side thrust loads on the parts which in addition to promoting wear, can result in damage to the parts. Additionally, these problems render it difficult to consistently produce acceptable end products, and to produce products at an acceptable parts per minute production rate without excessive down-time for maintenance and/or replacement operations. Additionally, the provision of close tolerances between relatively moving component parts undesirably adds to the initial manufacturing cost as well as maintenance and replacement cost in connection with the tooling.

So called "floating" tooling has of course been provided heretofore in which, in the case of a punch for example, the tool is so mounted that the working end can deflect into alignment with a die cavity or the like in which the forming work is performed. However, such self-alignment often requires engagement of the working end of the tool with a guide surface or the like which enables achieving alignment of the die and tool axes as the tool moves into the die. Such engagement between the tool and guide surface is undesirable for a number of reasons including, in connection with high speed tool movement, excessive wear and potential damage to the tool. Moreover, if such alignment is not achieved before the forming process begins, such self-aligning desplacement of the tool can result in the forming of an unacceptable product. This is especially true in connection with the forming of air gun pellets, both because of the size thereof and the material from which they are formed. Moreover, these problems are compounded as a result of high speed reciprocating displacement of the tool necessary to achieve a desired high production rate.

Tooling damage and the production of unacceptable workpieces have also been encountered heretofore, especially in connection with efforts to attain high speed production, as a result of the misfeeding of workpieces during the working cycle. In particular, the feeding of more than one workpiece into the tooling assembly, or the partial feeding of a workpiece thereinto, can result in jamming in the tool assembly and/or bending of the punch. Moreover, such misfeeding can result in damage to the parts of the assembly which the punch and workpiece are moving relative to. Even if such misfed workpiece material reaches the die, the excess or inadequacy of the amount of material results in an unacceptable product.

SUMMARY OF THE INVENTION

In accordance with the present invention, an improved tool assembly is provided for the die shaping of workpieces and in which the tool and die axes are self-aligning in a manner which overcomes the foregoing problems and disadvantages encountered in connection with alignment in such tool assemblies heretofore provided. More particularly in accordance with the present invention, a reciprocating tool such as a punch extends through a guide component having an end adjacent to the die and which is interengaged with the die to align the tool and die axes during the forming of a workpiece interposed therebetween. In the embodiment disclosed, the punch guide is mounted on a tool support or housing with sufficient clearance for the guide to float, and the punch extends through the guide with minimum clearance, whereby the punch is always in alignment with the punch guide. The driven end of the punch is connected to a drive component with sufficient clearance to permit the punch to seek the same center as the punch guide. When the die interengages with the punch guide, preferably by a clamping engagement, the punch and die axes are held in alignment and the punch is free to reciprocate without any lateral or bending stresses or the imposition of side thrusts on component parts of the tooling assembly which would promote wear.

In accordance with another aspect of the invention, the feed of workpieces to a position between the punch and die is through the punch guide, and the latter is reciprocable in the direction of the punch and during the total stroke of the punch to assure the feeding of a single workpiece to a position between the punch and die. More particularly in this respect, during the work stroke of the punch the punch guide is biased to a position which allows a workpiece to laterally engage the punch from a workpiece supply line, and during retraction of the punch relative to the die the guide component is biased to a position in which the discharge end of the supply line is blocked with respect to the displacement of a second workpiece therefrom. During continued retraction of the punch, the working end thereof passes beneath the one workpiece laterally engaging the punch, whereby the latter falls into the guide component forwardly of the working end of the punch. During the subsequent work stroke, the latter workpiece is displaced toward the die and the guide component is again biased to the position to permit another workpiece to move into lateral engagement with the punch. Thus, the guide component operates to positively assure the feeding of a single workpiece to the die during each cycle of operation of the tooling assembly.

It is accordingly an outstanding object of the present invention to provide an improved tool assembly of the character including a reciprocating tool and die cooperable to shape a workpiece interposed therebetween.

Another object is the provision of a tool assembly of the foregoing character in which the component parts are cooperable to assure the alignment of the tool and die axes during the shaping operation.

A further object is the provision of a tool assembly of the foregoing character in which the tool and die axes are aligned in a manner which minimizes wear and/or damage to the component parts of the assembly.

Still another object is the provision of a tool assembly of the foregoing character in which the die clampingly engages the tool guide prior to the forming operation to positively align the tool and die axes during the forming operation.

Yet another object is the provision of a tool assembly of the foregoing character in which the tool guide is operable during a cycle of operation of the tool assembly to assure the feeding of a single workpiece to the assembly for forming.

Still a further object is the provision of a tool assembly of the foregoing character in which the component parts are structured and structurally interrelated to provide for improved operating efficiency and product quality and a high production rate with reduced down time and reduced maintenance and replacement costs.

BRIEF DESCRIPTION OF THE DRAWINGS

The foregoing objects, and others, will in part be obvious and in part pointed out more fully hereinafter in conjuction with the written description of a preferred embodiment of the invention illustrated in the accompanying drawings in which.

DESCRIPTION OF A PREFERRED EMBODIMENT

Figure 1:
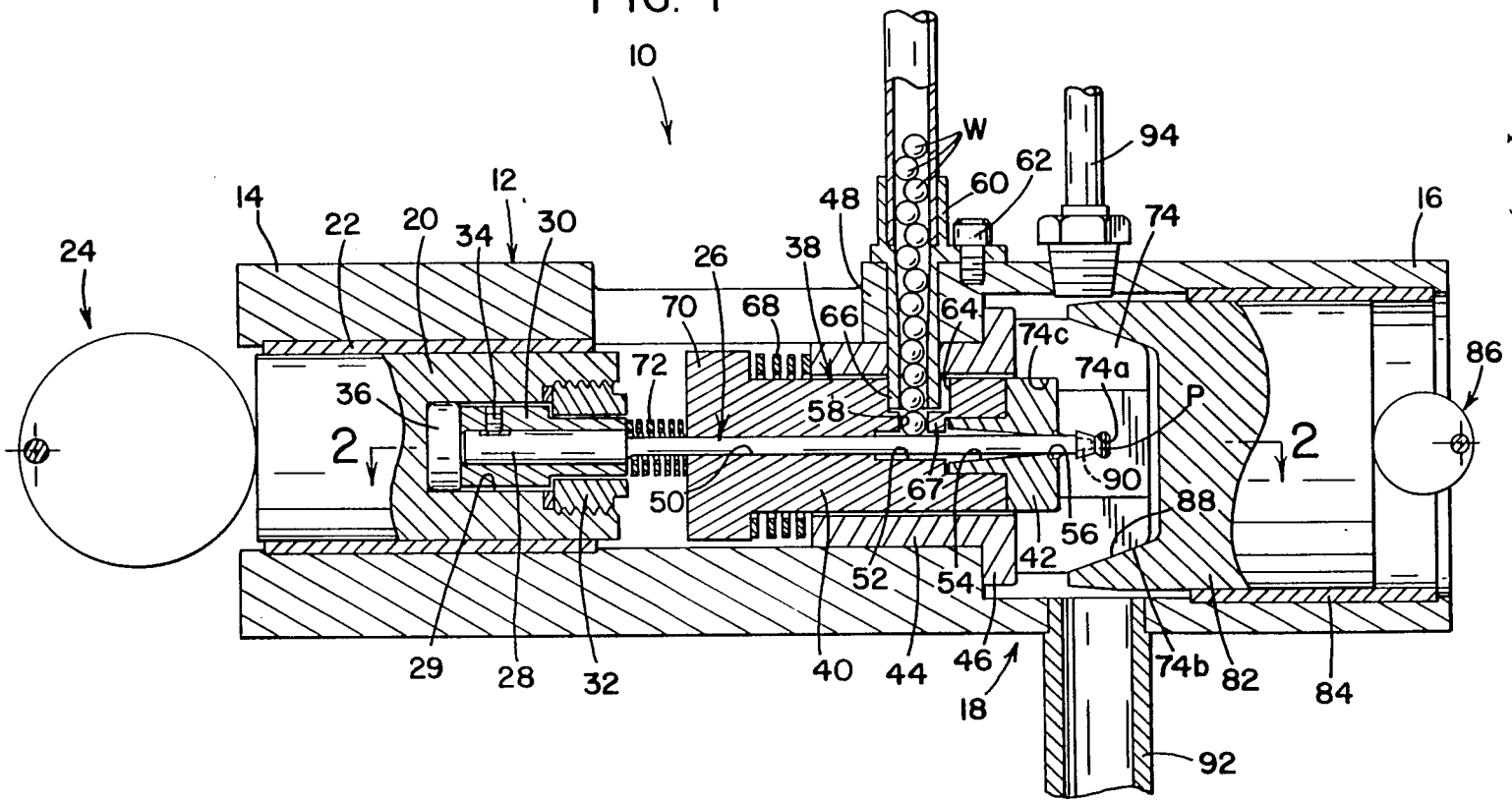
FIG. 1 is a sectional elevation view of a tool assembly in accordance with the present invention and showing the punch and die interengaged to shape a workpiece therebetween.
Figure 2:
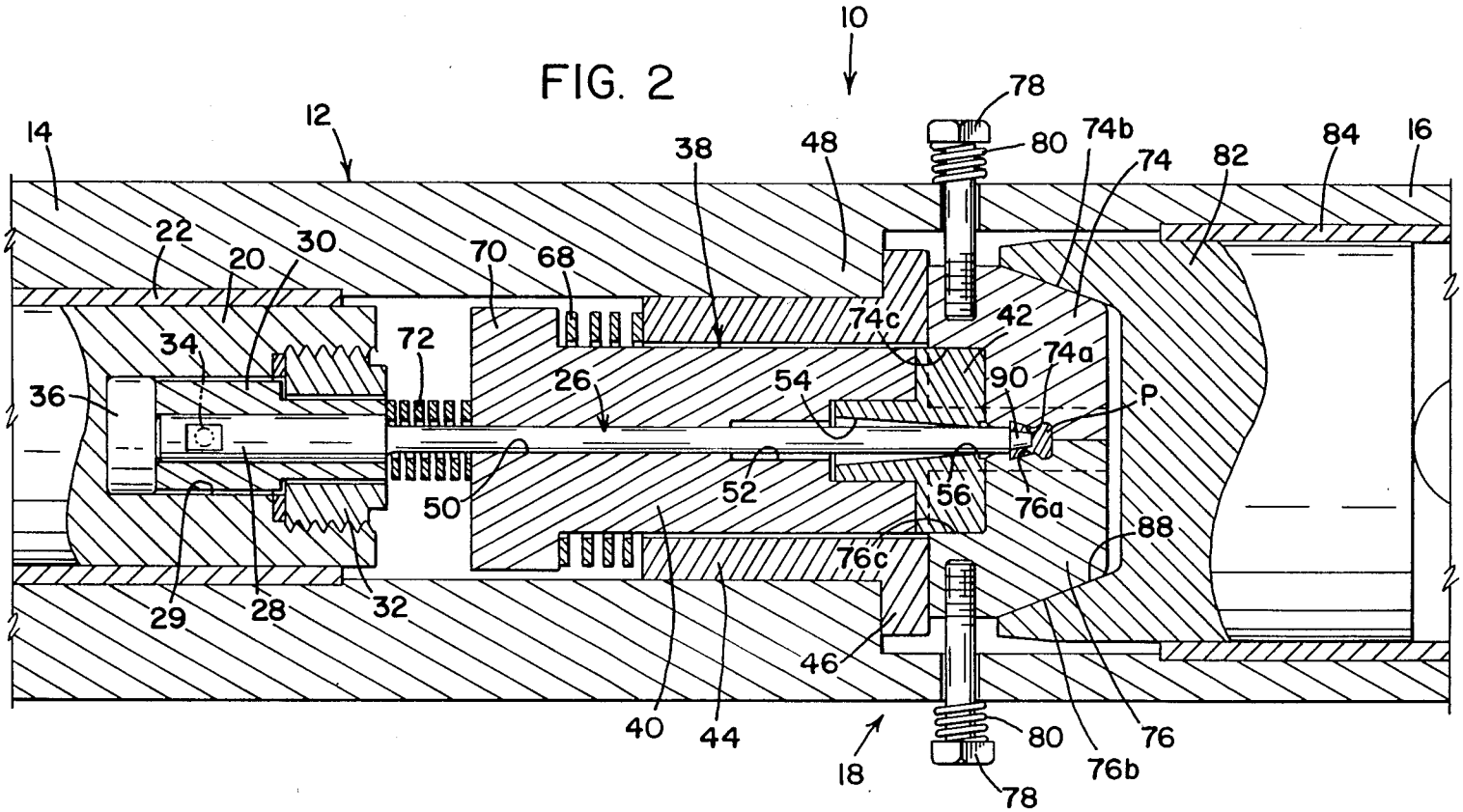
FIG. 2 is a plan view of the tool assembly in section, looking in the direction of line 2—2 in FIG. 1.
Figure 3:
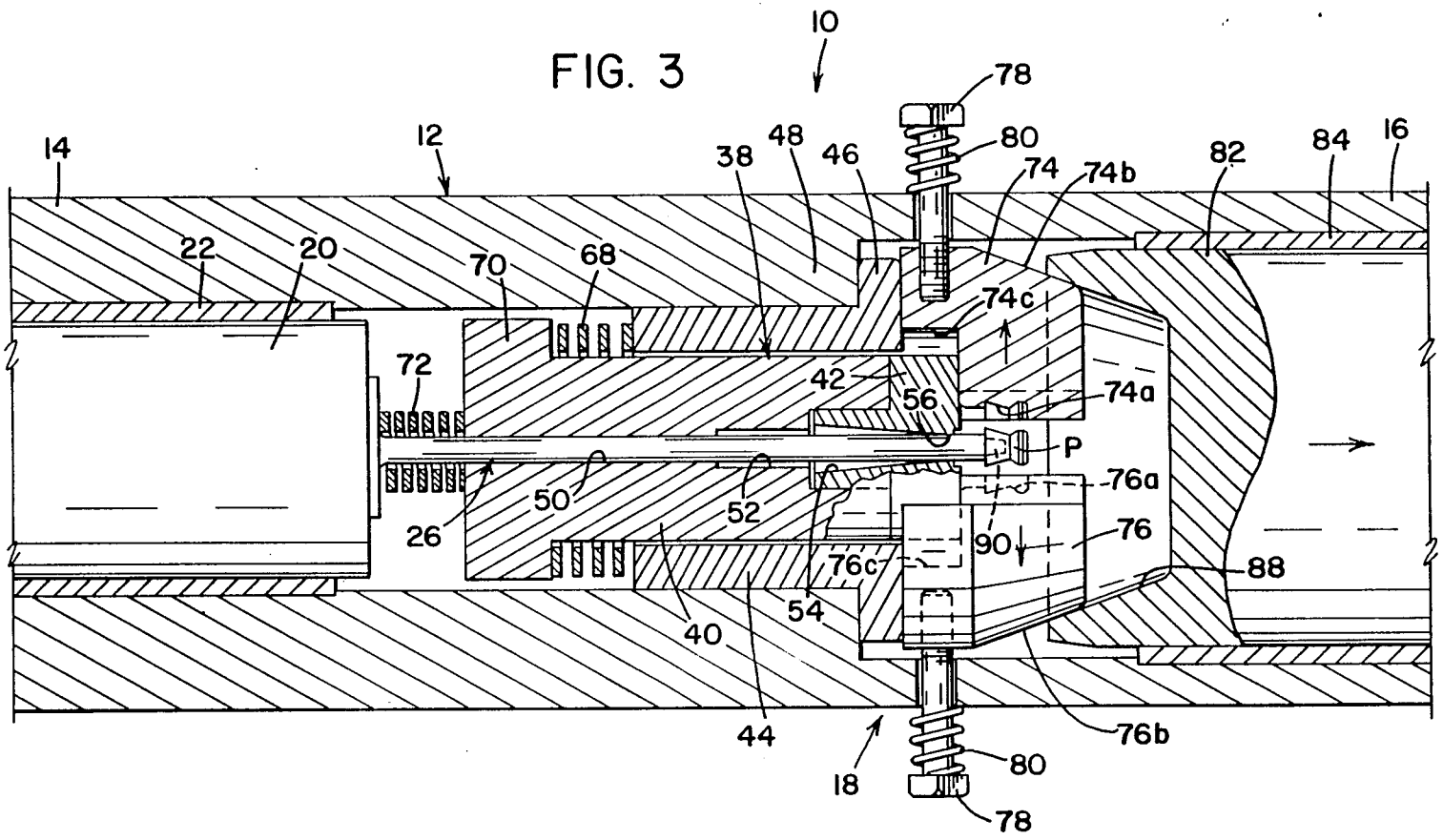
FIG. 3 is a plan view, in section, similar to FIG. 2 and showing the die halves open; and, FIGS. 4, 5 and 6 are sectional elevation views of the tool assembly showing the relative positions of the component parts and a workpiece to be formed during different portions of the total stroke of the punch.

Referring now in greater detail to the drawings wherein the showings are for the purpose of illustrating a preferred embodiment of the invention only and not for the purpose of limiting the invention, FIGS. 1–3 illustrate a tool assembly 10 comprising a tubular support or housing 12 having end portions 14 and 16 on opposite sides of a work area 18. It will be appreciated that housing 12 is adapted to be supported on a suitable frame or the like, not illustrated. A punch actuator 20 is reciprocably supported in housing 12 adjacent end portion 14 such as by means of sleeve bearings 22 and is adapted to be reciprocated in any suitable manner such as by a power driven cam assembly as schematically shown and indicated by numeral 24 in FIG. 1. An elongate punch 26 has a mounting end 28 secured in a recess 29 in punch actuator by means of a mounting sleeve 30 and lock nut 32. Punch end 28 is secured in sleeve 30 by a set screw 34, and lock nut 32 engages sleeve 30 against a punch anvil 36 therebehind. For the purpose set forth hereinafter, there is sufficient clearance between recess 29 and sleeve 30 and between the sleeve and lock nut 32 to permit lateral displacement of the punch forwardly of end 28 without bending the punch.

As will become apparent hereinafter, punch 26 is reciprocable through a total stroke which provides for the punch in its extendedmost positioin as shown in FIG. 1 to extend through a punch guide assembly 38 comprising a punch guide body 40 and a punch guide and preforming member 42 having an inner end received in a recess therefor in body 40 and secured therein such as by a press fit. Punch guide assembly 38 extends through a collar member 44 with sufficient clearance for the guide assembly to float relative thereto. Collar member 44 has a radially outwardly extending flange 46 which serves as a die stop, as explained more fully hereinafter, and sleeve 44 is secured in housing 12 such as by a press fit with an opening therein defined by a radially inwardly extending flange 48 of the housing. Punch guide body member 40 has a passageway therethrough including a punch guide passageway 50 having minimum clearance with the outside diameter of punch 26, and a workpiece receiving passageway 52 between the inner end of passageway 50 and the inner end of guide and preforming member 42. The latter member has a passageway therethrough including a tapered portion 54 at the inner end thereof and a punch guide portion 56 at the outer end thereof and having minimal clearance with respect to the outer diameter of punch 26.

Punch guide assembly 38 has a limited longitudinal reciprocating capability relative to sleeve 44 to facilitate the feed of workpieces to passageway 52 and to control such feed so as to assure only one workpiece is in the passageway during a cycle of operation of the tool assembly. More particularly in this respect, punch guide body portion 40 is provided with a workpiece receiving opening 58 communicating with passageway 52 and of a diameter slightly larger than the diameter of spherical workpieces W to be shaped during operation of the tool assembly. A workpiece guide tube component 60 is secured to housing 12 by means of a bolt 62 and extends radially inwardly through openings therefor in housing flange 48 and sleeve 44 and into an elongate slot 64 in punch guide body member 40. Slot has a lateral dimension corresponding to the outer diameter of discharge end 66 of guide tube 60 and has a longitudinal dimension slightly larger than the outer diameter of end 66. Accordingly, as will be appreciated from FIG. 1, punch guide assembly 38 is reciprocable longitudinally between the position shown and a position to the left in FIG. 1 which is determined by engagement of the right hand end of slot 64 with discharge end 66 of guide tube 60. When in the position shown in FIG. 1, opening 58 in punch guide body portion 40 is in alignment with discharge end 66 of guide tube 60, whereby a workpiece W can enter opening 58 to engage the outer surface of punch 26. It will likewise be appreciated that displacement of punch guide assembly 38 to the left in FIG. 1 positions portion 67 of the punch guide bodyu which is to the right of opening 58 partially across discharge end 66 of guide tube 60. Such positioning precludes the discharge of a workpiece from the guide tube with the punch guide assembly in the latter position. As will be described in greater detail hereinafter, longitudinal positioning of punch guide assembly 38 relative to sleeve 44 is achieved by a spring 68 between sleeve 44 and a flange 70 on the punch guide body, and by a spring 72 interposed between punch guide body 40 and mounting sleeve 30.

Tool assembly 109 further includes a die component which, in the embodiment disclosed, is a split die comprising laterally displaceable die halves 74 and 76 having corresponding die cavity portions 74*a* and 76*a* which are cooperable when the die halves are laterally engaged to provide a die cavity corresponding in contour to that of the outer surface of the air gun pellet to be formed therein. Each of the die halves is mounted on housing 12 for lateral displacement relative thereto by means of a bolt 78 extending through an opening therefor in housing 12 and having an inner end threadedly interengaged with the corresponding die half. Each bolt has a headed outer end, and a biasing spring 80 surrounds the shank of the bolt between housng 12 and the headed outer end to bias the die halves laterally outwardly to the position shown in FIG. 3 of the drawing. The die halves are displaced laterally inwardly into closed relationship by means of a die actuator 82 supported in housing 12 for longitudinal reciprocation by means of bearing sleeves 84. Die actuator 82 can be reciprocated in any suitable manner such as by a driven cam assembly as schematically shown in FIG. 1 and represented by numeral 86. More particularly with regard to actuation of the die halves, the latter have frusto-conical outer surfaces 74*b* and 76*b*, respectively, and the axially inner end of die actuator 82 has a frusto-conical recess of mating contour, whereby displacement of die actuator 82 to the left from the position shown in FIG. 3 operates to displace die halves 74 and 76 laterally inwardly to the closed position thereof shown in FIG. 2. The longitudinal reciprocation of die actuator 82 is such that cavity 88 thereof never completely disengages the die halves and, further, is such that the die halves can separate sufficiently for extraction of the formed workpiece therefrom as set forth hereinafter.

With further regard to die halves 74 and 76, and as will be appreciated from FIGS. 1–3, die half 74 has a recess 74*c* in the inner end thereof and die half 76 has a corresponding recess 76*c* in the inner end thereof. When the die halves are displaced laterally inwardly to the closed relationship, recesses 74*c* and 76*c* together provide a recess corresponding in contour to punch guide and preforming member 42 and adapted to clampingly interengage therewith as will be appreciated from FIGS. 1 and 2 of the drawing. As will be further appreciated from FIGS. 1–3, the axially inner end faces of die halves 74 and 76 abut against the outer face of die stop flange 46. Following the forming of a workpiece between working end 90 of punch 26 and the die cavity, as described in detail hereinafter, the die halves separate and the punch is retracted, whereby the formed product is stripped from the punch by engagement with the outer face of punch guide and preforming member 42. The product then falls by gravity into a discharge tube 92 opening into housing 12 and, to assist such discharge, a blast of air can be directed between the opened die halves through a tube 94 opening through housing 12 above discharge tube 92.

Figure 4:
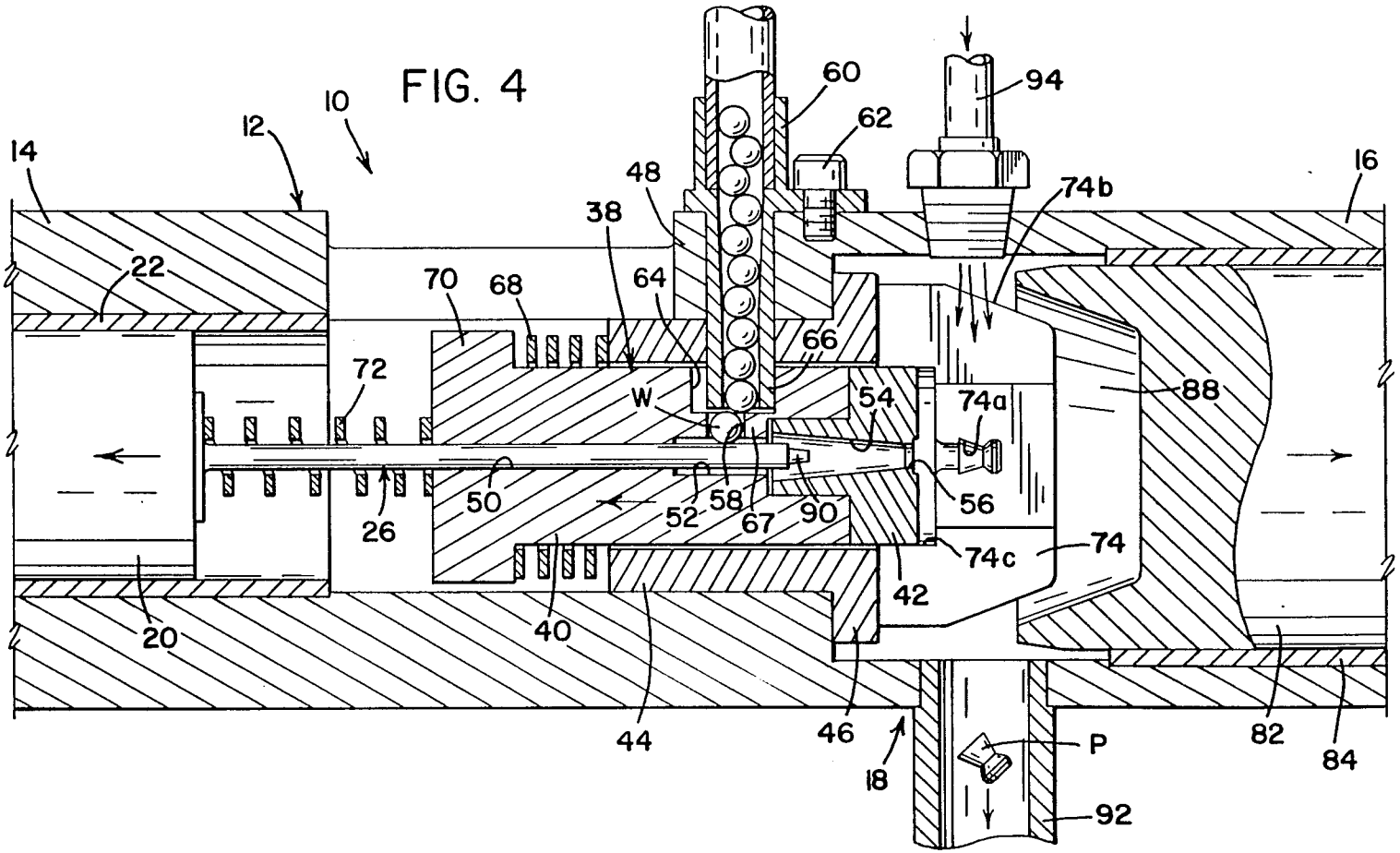
Figure 5:
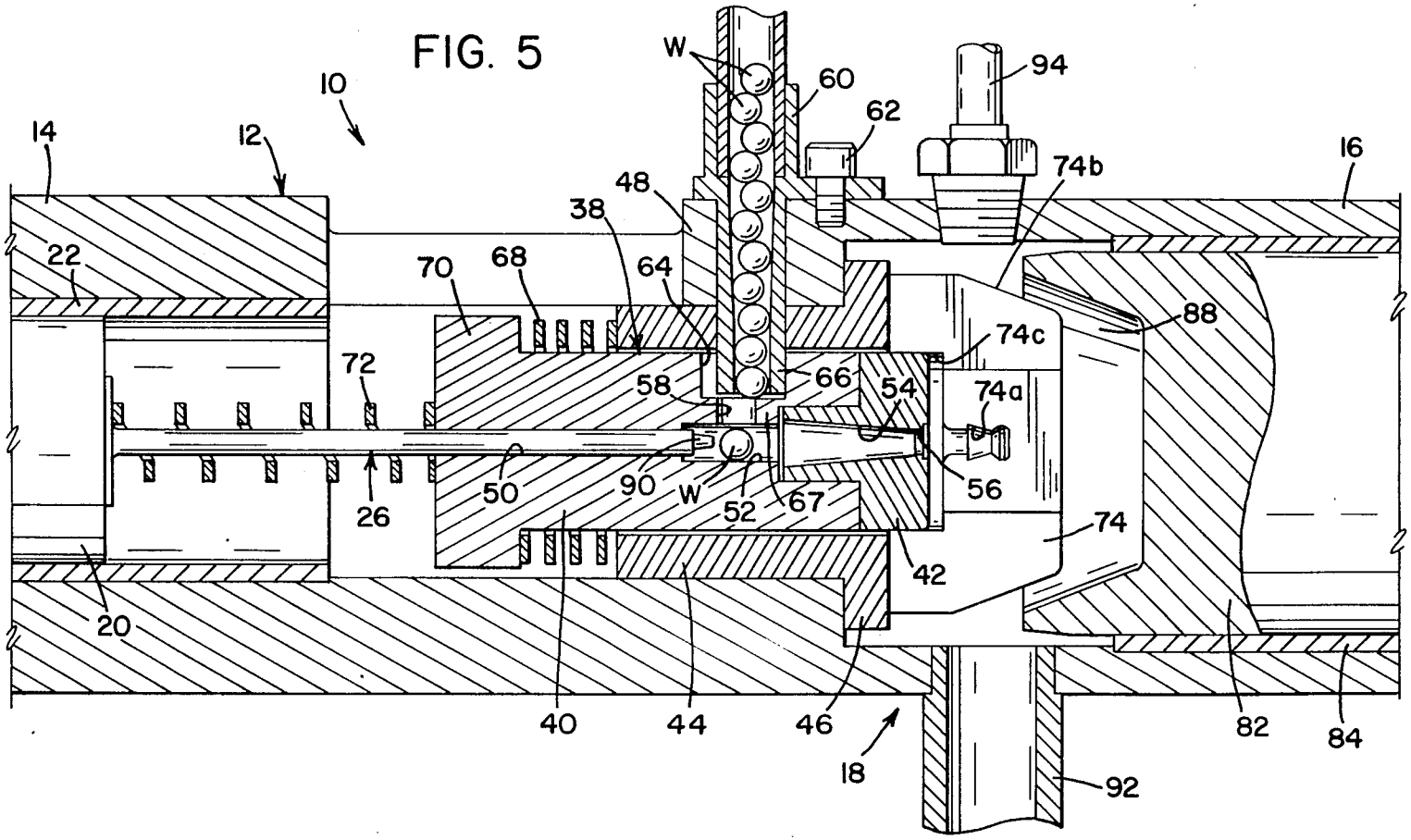
Figure 6:
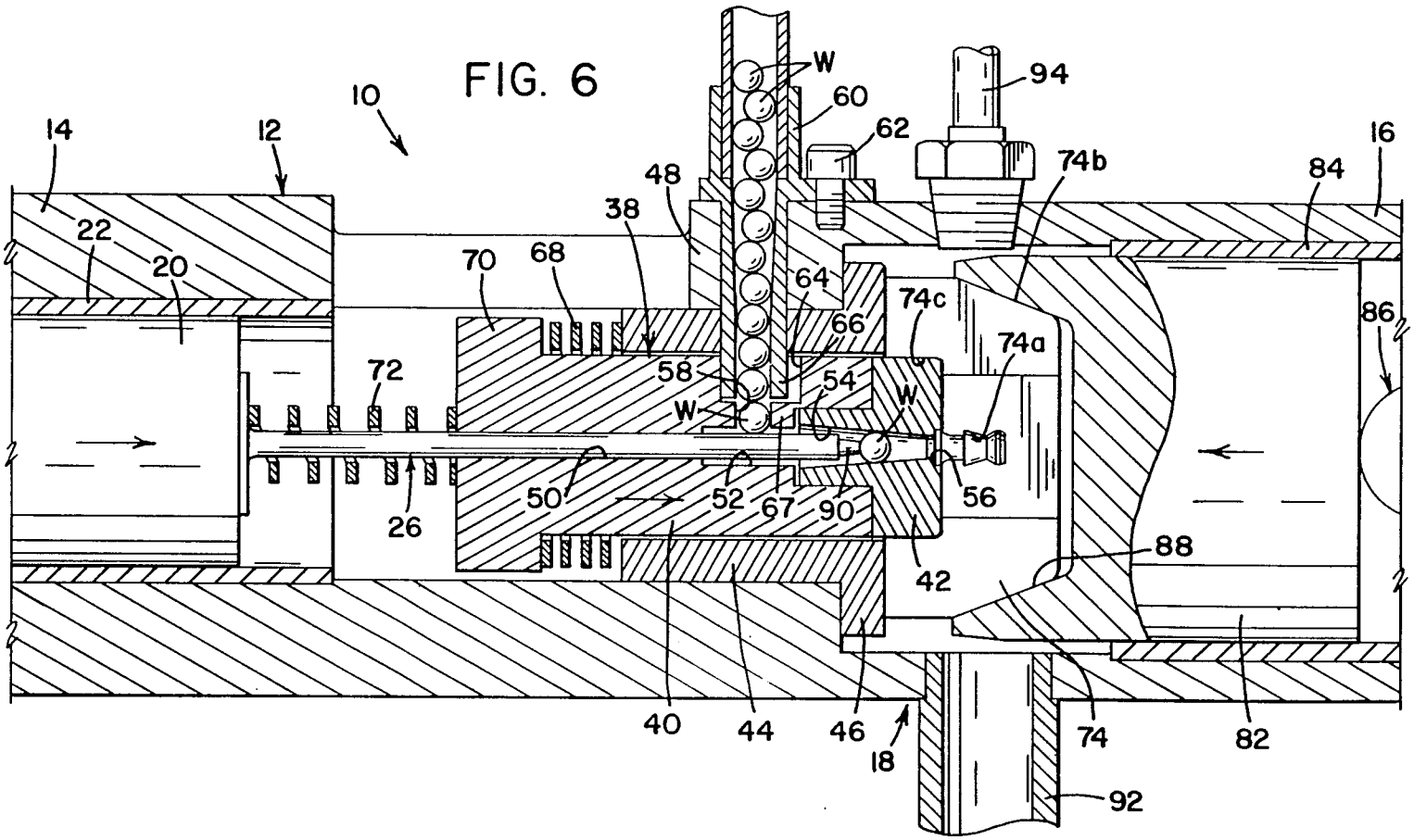

With the foregoing structure of the tool assembly in mind, it is believed that the following description of the operation will be clearly understood. Following the forming of a workpiece in the die cavity, the component parts are in the positions shown in FIGS. 1 and 2 of the drawing. At this time, die actuator 82 is displaced to the right in these Figures, whereby springs 80 displace die halves 74 and 76 laterally outwardly to the position shown in FIG. 3. Thereafter, punch actuator 20 is displaced to the left in FIG. 3, whereby the formed product P on working end 90 of the punch engages the outer face of punch guide and preforming member 42 and is stripped from the punch to fall into discharge tube 92. As the punch continues to retract to the left in FIG. 3, the force of spring 72 decreases and the force of spring 68 displaces punch guide assembly 38 to the left and to the position shown in FIG. 4 of the drawing, whereby the workpiece W in opening 58 is laterally offset from the discharge end 66 of guide tube 60 and the latter end is partially closed by portion 67 of punch guide body member 40. When punch 26 reaches the end of its return stroke, as shown in FIG. 5, the workpiece in opening 58 drops into passageway 52 in front of working end 90 of the punch. As the punch begins its forward stroke to the right from the position shown in FIG. 5, the force of spring 72 progressively increases due to compression thereof between punch guide body member 40 and sleeve 30 and, eventually, overcomes the force of spring 68 whereby punch guide assembly 38 is displaced to the right from the position shown in FIG. 5 to that shown in FIG. 6. At this time, the working end of the punch and the workpiece in front of the working end have moved past opening 58 which is once again aligned with discharge end 66 of guide tube 60 whereby the next workpiece falls into opening 58 against the outer surface of punch 26. Die actuator 82 is then displaced to the left to engage and displace die halves 74 and 76 laterally inwardly into clamping relationship with punch guide 38 and preforming member 42. Importantly in accordance with the present invention, the floating relationship between punch guide assembly 38 and sleeve 44 and the clearances provided between the mounted end of punch 26 and punch actuator 20 provide for the punch axis to be accurately aligned with the die cavity axis upon such clamping interengagement of the die halves with member 42. In part in this respect, the close fit between punch 26 and guide passageway 50 assures alignment between the punch and punch guide assembly, whereby the clamping of punch guide and preforming member 42 and the clearance at the mounted end of the punch assure alignment of the punch axis with the die axis free of any lateral deflection of the punch or exertion of side thrust forces on the relatively moving component parts. When the punch guide assembly has been so clamped by the dies, punch actuator 20 is displaced to the right in FIG. 5 whereby the workpiece in passageway 52 is displaced into the inner end of tapered passageway 54 of punch guide and preforming member 42 as will be appreciated from FIG. 6. The spherical shape of the workpiece is progressively elongated as the workpiece is pushed through passageway 54 and into the die cavity to the positions shown in FIGS. 1 and 2 for completion of the forming operation.

While considerable empahasis has been placed herein on the structure and operation of the embodiment disclosed, it will be appreciated that changes in the embodiment disclosed as well as other embodiments can be made without departing from the principles of the present invention. In particular in this respect, it will be appreciated that while the air gun pellets produced with the apparatus herein described are quite small, the positive alignment and workpiece feed control features are applicable to the die shaping of larger products from workpieces other than spherical lead workpieces, and that such shaping can be achieved with die components other than the split die herein disclosed. For example in this respect, the workpieces could be cup-shaped aluminum or steel can body workpieces, and the die could be in the form of an ironing ring through which the workpiece is pushed by the punch to draw and elongate the can body. It is only important in connection with the present invention that the die interengage with the punch or tool guide to positively align the tool and die axes during the workpiece forming operation. In connection with the latter as shown and described herein, for forming air gun pellets, it will be appreciated that a punch and die can be cooperable in shaping a workpiece without the need of a preforming member at the end of the guide which interengages with the die. Thus, the equivalent of the preforming member for purposes of engagement with the die could be an integral projection on the guide member.

The above and other changes as well as other embodiments of the invention will be obvious and suggested to those skilled in the art from the description of a preferred embodiment herein, whereby it is to be distinctly understood that the forgoing descriptive matter is to be interpreted merely as illustrative of the present invention and not as a limitation.

Having described the invention, it is claimed:

1. A self-aligning tool assembly for die shaping workpieces, comprising support means, die means on said support means and having a die axis, tool means on said support means having a tool axis and a working end, means for reciprocating said tool means axially through a stroke including a working portion in which said working end and said die means cooperatively shape a workpiece therebetween, guide means supporting said tool means adjacent said die means, and align-ing means on said guide means and die means clampingly interengaged against relative axial and lateral displacement during said working portion of said stroke and aligning said die and tool during said working portion of said stroke.

2. A tool assembly according to claim 1, wherein said stroke of said tool means includes a portion in which said working end is axially spaced from said die means, and means to feed a workpiece to the space between said working end and die means.

3. A tool assembly according to claim 2, wherein said guide means includes means to control the feed of a workpiece to said space.

4. A tool assembly according to claim 2, wherein said means to feed a workpiece includes means providing a feed path for workpieces, and said guide means is displaceable between first and second positions relative to said path, said guide means in said first position allowing movement of workpieces along said path and in said second positon blocking movement of workpieces along said path.

5. A tool assembly according to claim 4, and means displacing said guide means between said first and second positions during said stroke of said tool means.

6. A tool assembly according to claim 1, wherein said aligning means includes axially interengaging recess and projection means on said die means and guide means.

7. A tool assembly according to claim 6, wherein said recess means is in said die means and said projection means is on said guide means.

8. A tool assembly according to claim 7, wherein said recess means and projection means are concentric with said die axis.

9. A tool assembly according to claim 8, wherein said stroke of said tool means includes a portion in which said working end is axially spaced from said die means, and means to feed a workpiece to the space between said working end and die means.

10. A tool assembly accordig to claim 9, wherein said means to feed a workpiece includes means providing a feed path for workpieces, and said guide means is displaceable between first and second positions relative to said path, said guide means in said first position allowing movement of workpieces along said path and in said second position blocking movement of workpieces along said path.

11. A tool assembly according to claim 10, and means displacing said guide means between said first and second positions during said stroke of said tool means.

12. A self-aligning tool assembly for die shaping workpieces comprising, support means having opposite ends, die means on said support means between said ends and having a die axis in the direction between said ends, punch means having a punch axis coaxial with said die axis and having working and driven ends, punch actuator means connected to said driven end and reciprocable on said support means to displace said working end toward and away from said die means, punch guide means on said support means between said die means and said punch actuator means, said guide means including a guide passageway therethrough coaxial with and reciprocably receiving and guiding said punch means, said guide means and die means having axially interengaging projection and recess means aligning said die and punch axes and means clampingly interengaging said projection and recess means against relative axial and lateral displacement during reciprocation of said punch means.

13. A tool assembly according to claim 12, wherein said die means is displaceable between working and non-working positions relative to said support means, and means including die actuator means for displacing said die means between said postions thereof.

14. A tool assembly according to claim 13, wherein said die means includes a plurality of die segments laterally displaceable relative to said die axis between laterally closed and open relationships respectively corresponding to said working and non-working positions.

15. A tool assembly according toclaim 14, wherein said die actuator means is axially reciprocable toward and away from said die segments and said segments and die actuator means include means interengaging during displacement of said die actuator means toward said segments to displace said segment from said open to said closed relationship.

16. A tool assembly according to claim 12, wherein said guide means has end means coaxial with said die axis and providing said projection means, and said die means has a recess coaxial with said die axis and providing said recess means.

17. A tool assembly according to claim 16, wherein said die means is displaceable between working and non-working positions relative to said support means, and means including die actuator means for displacing said die means between said positions thereof, said recess in said die means engaging said end means on said guide means when said die means is in said working position.

United States Patent [19]

Juengel

[11] Patent Number: 4,693,110

[45] Date of Patent: Sep. 15, 1987

[54] METHOD AND APPARATUS FOR TESTING THE OPERABILITY OF A PROBE

[75] Inventor: Richard O. Juengel, Romeo, Mich.

[73] Assignee: GTE Valeron Corporation, Troy, Mich.

[21] Appl. No.: 741,869

[22] Filed: Jun. 6, 1985

[51] Int. Cl.[4] ..... G01D 18/00; G01M 19/00; G01B 11/00

[52] U.S. Cl. ..... 73/1 R; 364/474; 33/555; 33/558; 340/514; 340/636; 340/680

[58] Field of Search ..... 73/1 R, 1 D, 1 J, 865.9; 33/555-559, 561, DIG. 3, 169 R, 502; 340/680, 636, 514, 825.16, 825.23, 825.76; 324/426, 433; 364/474.37

[56] References Cited

U.S. PATENT DOCUMENTS

| | | | |
|---|---|---|---|
| 3,539,912 | 11/1970 | Wardle | 73/1 R X |
| 4,153,998 | 5/1979 | McMurtry | 33/556 |
| 4,163,938 | 8/1979 | Moore | 73/1 R X |
| 4,276,698 | 7/1981 | Dore et al. | 33/169 R X |
| 4,339,714 | 7/1982 | Ellis | 33/559 X |
| 4,380,873 | 4/1983 | Ayres et al. | 33/556 |
| 4,401,945 | 8/1983 | Juengel | 33/556 X |
| 4,437,240 | 3/1984 | Juengel et al. | 33/558 X |
| 4,447,958 | 5/1984 | Tanaka | 33/561 |
| 4,509,266 | 4/1985 | Cusack | 33/DIG. 3 X |
| 4,521,769 | 6/1985 | Dudeck et al. | 73/1 R X |
| 4,548,066 | 10/1985 | Martinez et al. | 73/1 J |

FOREIGN PATENT DOCUMENTS

| | | | |
|---|---|---|---|
| 2063693 | 6/1972 | Fed. Rep. of Germany | 73/1 R |
| 89460 | 7/1981 | Japan | 33/169 R |
| 111408 | 7/1982 | Japan | 73/1 R |
| 183362 | 10/1984 | Japan | 73/1 R |
| 15515 | 1/1985 | Japan | 73/1 R |
| 937381 | 9/1963 | United Kingdom | 33/169 R |

*Primary Examiner*—Tom Noland

*Attorney, Agent, or Firm*—Harness, Dickey & Pierce

[57] ABSTRACT

The present invention is directed to an apparatus and method of testing the operability of probes used in performing workpiece probing operations. According to the preferred embodiment of the present invention, the probe has a first circuit for generating a first signal, the first signal inducing the probe to generate a second signal. A second circuit is provided for receiving the second signal. The second circuit is adapted to generate a third signal indicative of the operability of the probe when the second signal is received. In the preferred embodiment, an infrared signal is delivered by the apparatus to the probe causing the probe to emit an infrared signal. The infrared signal emitted by the probe is then used by the apparatus to generate an electrical signal indicative of the operability of the probe.

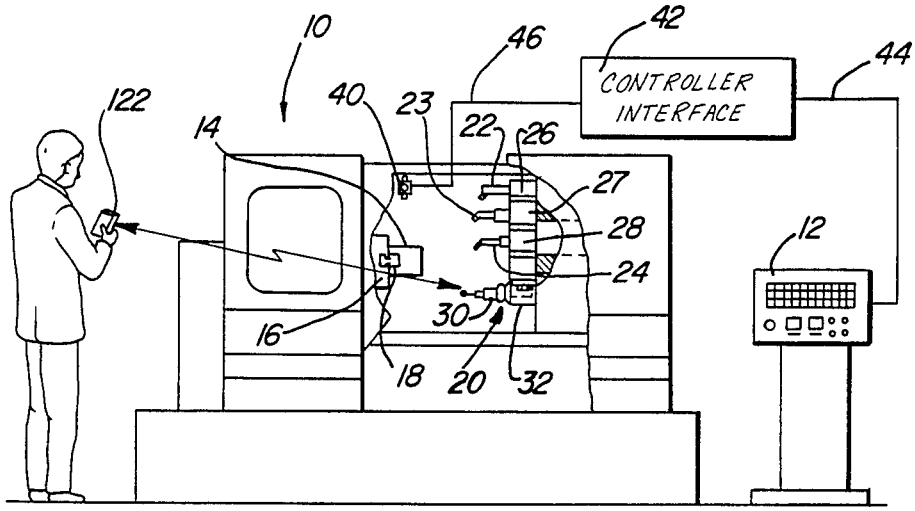

21 Claims, 7 Drawing Figures